US005261634A

United States Patent [19]

Nakamura

[11] Patent Number: 5,261,634

[45] Date of Patent: Nov. 16, 1993

[54] SUPPORT STRUCTURE FOR A DOCUMENT HOLDER

[75] Inventor: Toshiyuki Nakamura, Shiga, Japan

[73] Assignee: Mita Industrial Co., Ltd., Osaka, Japan

[21] Appl. No.: 954,709

[22] Filed: Sep. 30, 1992

[30] Foreign Application Priority Data

Oct. 9, 1991 [JP] Japan ..... 3-262093

[51] Int. Cl.[5] ..... A47B 19/00

[52] U.S. Cl. ..... 248/441.1; 355/75; 355/230

[58] Field of Search ..... 248/441.1, 447, 445, 248/447.1, 447.2, 454, 455, 456; 355/230, 75

[56] References Cited

U.S. PATENT DOCUMENTS

| | | | |
|---|---|---|---|
| 3,498.709 | 3/1970 | Kaminstein | 355/230 X |
| 3,614,220 | 10/1971 | Komori | 355/230 X |
| 4,135,805 | 1/1979 | Taylor | 355/75 X |
| 4,285,512 | 8/1981 | Shlatz | 355/230 X |
| 4,320,952 | 3/1982 | Seimiya | 355/230 X |
| 4,550,243 | 10/1985 | Hashimoto | 355/230 UX |
| 4,812,874 | 3/1989 | Kubota | 355/230 X |
| 5,060,018 | 10/1991 | Watanabe | 355/75 X |
| 5,119,213 | 6/1992 | Graves | 355/75 X |
| 5,177,535 | 1/1993 | Watanabe | 355/230 |

*Primary Examiner*—J. Franklin Foss

*Attorney, Agent, or Firm*—Jordan and Hamburg

[57] ABSTRACT

A support structure is provided at an upper rear end portion of a housing of a main body of an image forming apparatus for supporting a document holder provided with a conductive support column. The support structure includes a supporting device for supporting the conductive support column of the document holder, the supporting device including a contact portion made of a conductive material and connected with a frame of the main body. In the state where the document holder is supported by the support device, a front face of the support column is in contact with the contact portion. Consequently, static charges accumulated on the document holder can be brought to the frame of the main body through the support column and the contact member, thereby preventing an operator to receive an electric shock.

4 Claims, 4 Drawing Sheets

SUPPORT STRUCTURE FOR A DOCUMENT HOLDER

BACKGROUND OF THE INVENTION AND RELATED ART STATEMENT

This invention relates to a support structure for supporting a document holder on a main body of a copier, a facsimile apparatus, or like image forming apparatus and, more particularly to a support structure for a document holder suitable in the case where the document holder carries an automatic document feeder.

FIG. 4 shows a fragmentary sectional view of an image forming apparatus such as a copier and a facsimile apparatus. On the top of this image forming apparatus is provided openably and closably a document holder 6 for holding a document (not shown) placed on a document platen 91.

A housing 8 for a main body 9 of the image forming apparatus is made of resin. At a rear end portion (a right end portion in FIG. 4) of an upper surface 8*a* of the housing 8, there is a support frame 31 in the shape of a relatively long box formed integrally with the upper surface 8*a*. The frame 31 is open upward. A metal support column 7 connected to an opening/closing mechanism 61 for the document holder 6 is fitted into the support frame 31, and thereby the document holder 6 is attached to the main body 9.

The document holder 6 carries an automatic document feeder (hereinafter referred to as an ADF) constructed so as to feed a document to a specified position on the document platen 91 by means of a transport belt 64. The document holder 6 of this type is charged with static charges generated by the friction between the document and the transport belt 64 or the like, and has conventionally required to be grounded to a frame of the main body 9 through the support column 7 lest an operator should receive an electric shock.

However, the conventional support frame 31 is integrally formed with the upper surface 8*a* made of resin as described above. The frame of the main body 9 is adapted for fixedly holding respective members used for image formation in specified positions. Accordingly, the support frame 31 and the frame of the main body 9 are basically fixedly positioned relative to each other. Normally, the support frame 31 is spaced apart from the frame of the main body 9 by a specified distance in consideration of the operability of the image forming apparatus.

In view of the above, in the conventional image forming apparatus, an electrode is provided in the support frame 31 formed of resin, and a lead wire is provided between this electrode and the frame of the main body 9. By bringing the support column 7 into direct contact with the electrode, the document holder 6 is grounded through the lead wire. The conventional way of grounding is cumbersome and time-consuming, thereby resulting in an increased manufacturing cost.

This problem may be solved by forming the housing 8 entirely of metal and grounding the document holder 6 through the housing 8. However, this increases the weight of the image forming apparatus. Further, this is unnecessary and causes an increase in the manufacturing cost for the document holder 6 not carrying the ADF.

SUMMARY OF THE INVENTION

It is an object of the invention to provide a support structure which is capable of grounding a document holder to a main body of an image forming apparatus with a simple structure and a specified strength.

According to the invention, a support structure for supporting a document holder provided with a support column, the document holder being attachable to an upper rear end portion of a housing of a main body of an image forming apparatus, the support structure comprising holding means for holding the support column of the document holder, the holding means having a contact portion made of a conductive material and made in contact with a front face of the support column, the contact portion being connected with the a frame of the main body.

With the support structure thus constructed, the front face of the support column comes to contact with the contact portion in the state where the support column is held by the holding means. Consequently, the support column is grounded to the frame of the main body through the contact portion. Accordingly, static charges accumulated on the document holder can be brought to the frame of the main body through the support column and the contact portion, preventing undesirable likelihood that an operator receives an electric shock. Further, provision of the contact portion allows the support structure to have specified as strength, which is advantageous in supporting the conductive column.

The contact portion may be a part of the frame, the part projecting toward the front face of the support column. This causes reduction in the number of parts constituting the support structure.

Also, there may be provided a connecting member for connecting the contact portion with the housing of the main body. This enables the housing to be connected with the frame.

Further, the holding means further includes a rib member extending from a rear surface of the housing toward a rear face of the support column so as to support the rear of the support column. With the rib member, the rear face of the support column can be formed integrally with the rear surface of the housing of the main body.

These and other objects, features and advantages of the present invention will become more apparent upon a reading of the following detailed description and accompanying drawings.

DETAILED DESCRIPTION OF PREFERRED EMBODIMENTS OF THE INVENTION

Figure 1:
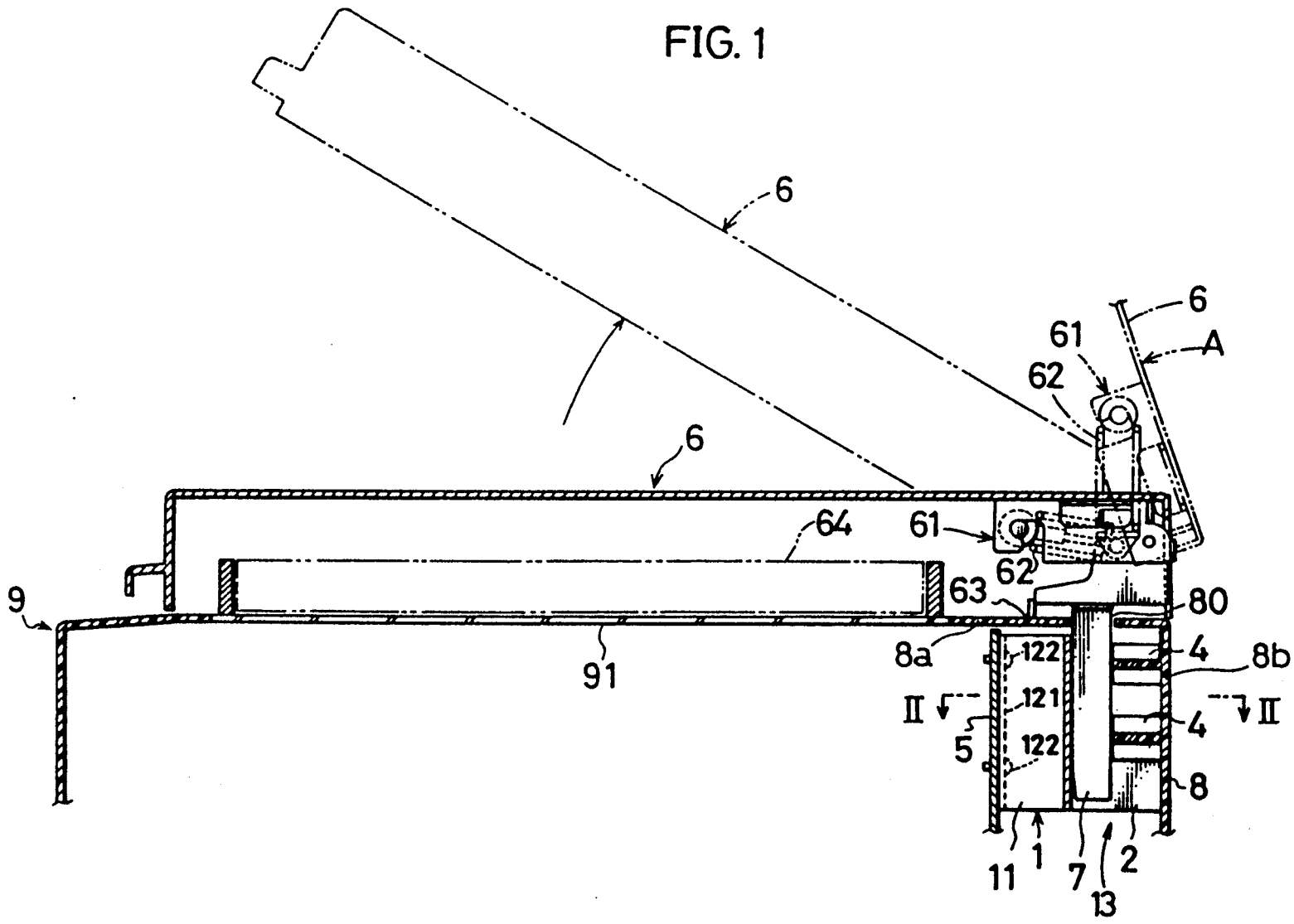
FIG. 1 is a sectional view showing a document holder including a support structure according to the invention.

FIG. 1 is a sectional view showing an exemplary document holder carrying an ADF.

A document holder 6 is adapted for transporting a document placed on an unillustrated document setting portion to a specified position on a document platen 91 by means of a transport belt 64, etc., causing the document to stay temporarily at the specified position, and discharging the document onto an unillustrated discharge tray after an image of the document is read by an unillustrated scanning system arranged below the document platen 91. The document holder 6 is provided with an opening/closing mechanism 61 for opening and closing the document holder 6 relative to a main body 9 of the image forming apparatus. The mechanism 61 includes a helical spring 62 and the like. The force given to open the document holder 6 can be minimized by biasing the document holder 6 toward an obliquely upward direction by the helical spring 62. A moment is generated by the spring force of the helical spring 62 in a clockwise direction in the drawing of FIG. 1 about a supporting point 63. With thus generated moment, a front face of a support column 7 comes to contact with a support member 1 to be described later. The support column 7 includes a conductive rectangular column or the like of the specified length made of, e.g. metal, and is fixed to a lower end of the opening/closing mechanism 61. The support member 1 constitutes a contact portion of the support structure.

Figure 2:
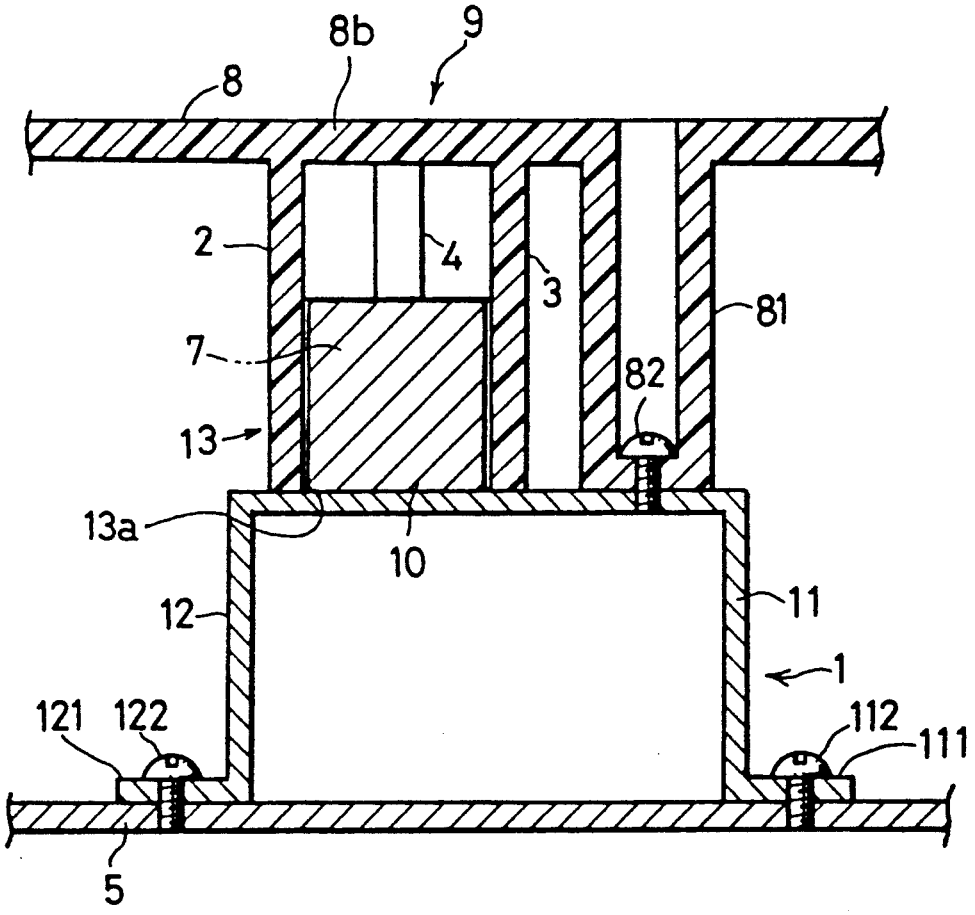
FIG. 2 is a sectional view taken along the line II—II in FIG. 1.
Figure 3:
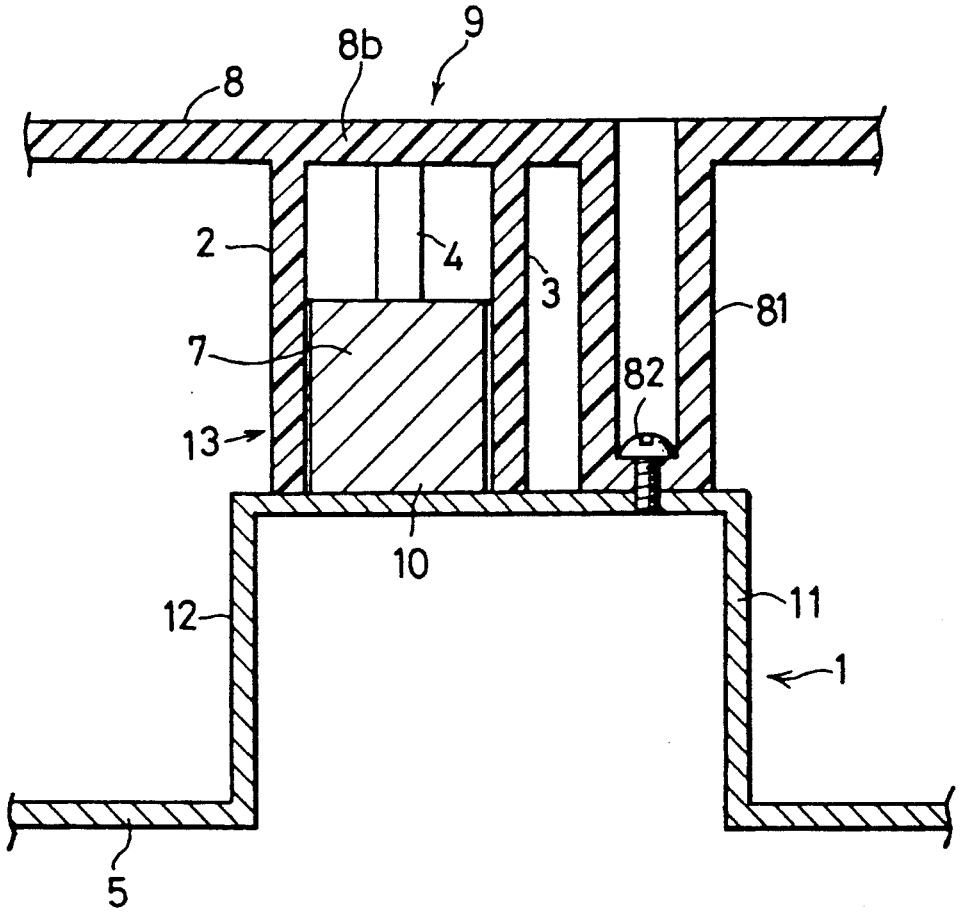
FIG. 3 is a sectional view showing another support structure according to the invention.
Figure 4:
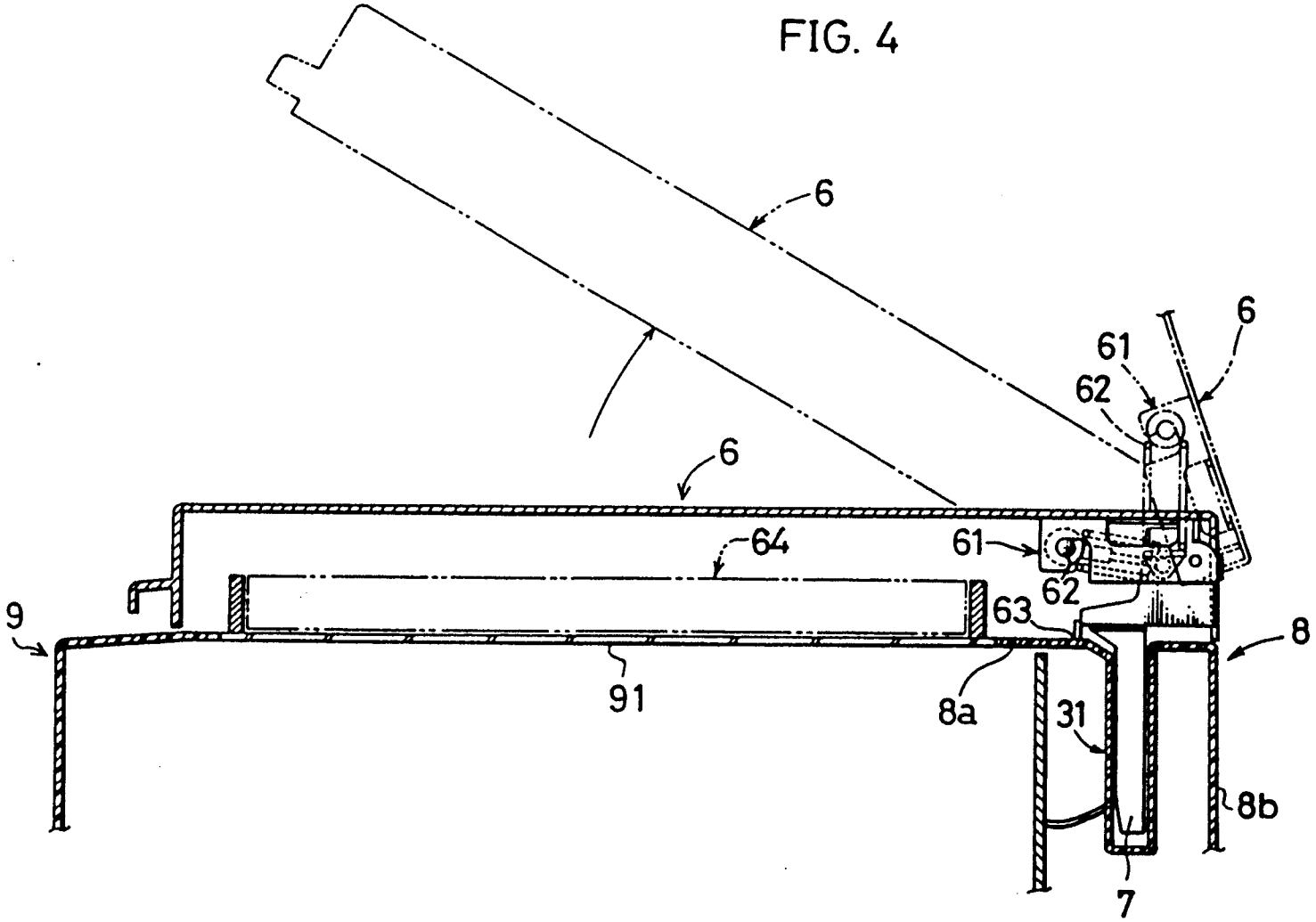
PRIOR ART FIG. 4
FIG. 4 is a sectional view showing a support structure of prior art.

FIG. 2 is a sectional view showing an exemplary support structure for the document holder according to the invention.

The support structure includes holding means having the support member 1 having a cross-section substantially U-shaped, a support frame 13 consisting of rib members 2, 3, and 4 extending from a rear surface 8*b* of a housing 8 made of resin, and an opening 80 defined in the upper surface 8*a* of the housing 8 (see FIG. 1). The support column 7 of the document holder 6 is inserted into the opening 80 to be fitted in a space 10 in the form of a rectangular parallelepipeds defined in the support frame 13, and thereby the document holder 6 is supported on the main body 9. It will be appreciated that the shape of the opening 80 and the space 10 is determined according to the shape of the support column 7.

The rib members 2, 3 defines side walls of the support frame 13. These rib members are spaced apart by a distance corresponding to the width of the support column 7 in parallel with each other along the rear surface 8*b* and extend vertically downward from front and rear edges of the opening 80. These rib members 2, 3 are designed to support the opposite side faces of the support column 7 inserted through the opening 80. The rib members 4 defines a rear wall of the support frame 13, and a plurality of those are provided at specified spacings along the rear surface 8*b* of the housing 8 between the rib members 2 and 3. The length of the rib members 4 is set at a distance between the rear surface 8*b* and the rear edge of the opening 80. The rib members 4 are designed to support the rear face of the support column 7.

There is described the effect which is obtainable by forming the rib members 2, 3, and 4 of the support frame 13 at the rear surface 8*b* of the housing 8. In existing support structures for document holders, the upper surface 8*a* and the rear surface 8*b* have been divided by the rear part of the support frame, thereby forming the upper surface 8*a* of the housing 8 and the relatively long box-shaped support frame 13 integrally with each other. This has complicated the shape of a metal mold for the upper surface 8*a*. However, according to the invention, since the rib members 2, 3, and 4 of the support frame 13 are formed on the rear surface 8*b* of the housing 8 as described above, the shape of the metal mold for the upper surface 8*a* can be simplified. Further, since the distance between the rear surface 8*a* and the front face of the support column 7 is relatively short, the lengths of the rib members 2, 3, and 4 are not very long. Thus, a metal mold for the rear surface 8*b* can be also formed relatively simply.

The support member 1 is made of conductive metal and has the length substantially equal to the length of the support column 7. Opposite side portions of the support member 1 are bent toward a main body frame 5, thereby forming opposite side walls 11, 12. Ends of the side walls 11, 12 are bent outward, thereby forming bent portions 111, 121. The bent portions 111, 121 are secured to the main body frame 5 with screws 112, 122 or the like. In this way, the support member 1 is secured to the main body frame 5. The length of the side walls 11, 12 is set equal to a distance between a front opening 13*a* of the support frame 13 and the main body frame 5. Thus, the support member 1 is connected to the main body frame 5 so that a rear face of the support member 1 covers the front opening 13*a*.

The main body frame 5 is made of a metal plate, and is so constructed as to function as a ground. The document holder 6 is grounded through the support column 7 and the support member 1 by inserting the support column 7 through the opening 80 and bringing the support column 7 into contact with the support member 1 by the aforementioned moment generated by the helical spring 62.

The housing 8 is provided with a boss (connecting member) 81 extending from the rear surface 8*b* horizontally (vertically in the drawing of FIG. 2) toward the main body frame 5. The housing 8 is connected to the support frame 1 by connecting the boss 81 with the support frame 1 with a screw 82. In this way, the housing 8 is connected to the main body frame 5 through the support member 1.

As described above, since the support member 1 is made of a conductive metal plate and is fixed to the main body frame 5, the document holder 6 is grounded to the main body frame 5 through the support column 7 and the support member 1 when the support column 7 is brought into contact with the support member 1 by the moment generated by the helical spring 62. Although a relatively large force is exerted on the support member 1 by the moment generated by the helical spring 62, the support member 1 can resist such a force because it is made of a metal plate and is fixed to the main body frame 5. Accordingly, the support member 1 is not subject to distortion or damage even when the document holder 6 carries a heavy ADF.

In the foregoing embodiment, the separately formed support member 1 is fixed to the main body frame 5 so as to support the support column 7 of the document holder 6. However, it may be appropriate that the main body frame 5 is so formed as to have a projected portion projecting toward the front opening 13*a* of the support frame 13 and that the front face of the support column 7 is supported by this projected portion. In this case, since the main body frame 5 and the support frame 1 are integrally formed, a mounting operation of the support structure can be simplified and the number of members can be reduced.

Further, the shape of the support column 7 is not limited to a rectangular parallelepipeds, but may be a cylinder or the like. In the case where the support column 7 is cylindrical, the shape of the support member 1 and the rib members 2, 3, 4 are changed so as to define the space 10 corresponding to the shape of the support column 7.

Moreover, in the foregoing embodiment, the document holder 6 carrying the ADF is attached to the main body 9.

However, it goes without saying that document holders not carrying the ADF are also attachable to the main body 9 according to the invention.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A support structure for supporting a document holder provided with a support column, the document holder being attachable to an upper rear end portion of a housing of a main body of an image forming apparatus, the support structure comprising:

holding means for holding the support column of the document holder, the holding means having a contact portion made of a conductive material and made in contact with a front face of the support column, the contact portion being connected with the a frame of the main body.

2. A support structure as defined in claim 1 wherein the contact portion is a part of the frame, the part projecting toward the front face of the support column.

3. A support structure as defined in claim 1 further comprising a connecting member for connecting the contact portion with the housing of the main body.

4. A support structure as defined in claim 1 wherein the holding means includes a rib member extending from a rear surface of the housing toward a rear face of the support column so as to support the rear of the conductive column.

* * * * *